US005154021A

United States Patent [19]

Bombardier et al.

[11] Patent Number: 5,154,021

[45] Date of Patent: Oct. 13, 1992

[54] PNEUMATIC PAD CONDITIONER

[75] Inventors: Susan G. Bombardier, Bolton; James R. Day, South Hero, both of Vt.

[73] Assignee: International Business Machines Corporation, Armonk, N.Y.

[21] Appl. No.: 863,392

[22] Filed: Apr. 3, 1992

Related U.S. Application Data

[63] Continuation of Ser. No. 721,733, Jun. 26, 1991, abandoned.

[51] Int. Cl.[5] ..... B24B 53/00

[52] U.S. Cl. ..... 51/262 A; 51/325

[58] Field of Search ..... 51/262 R, 262 A, 262 T, 51/266, 281 R, 325

[56] References Cited

U.S. PATENT DOCUMENTS

| | | | |
|---|---|---|---|
| 2,563,096 | 9/1951 | Stewart | 51/262 A |
| 3,031,195 | 1/1961 | Lunsford . | |
| 3,177,627 | 4/1965 | Guibert et al. | 51/262 A |
| 3,754,359 | 8/1973 | Scandaletos | 51/356 |
| 3,907,257 | 9/1975 | Drzewiecki | 51/170 X |
| 4,525,955 | 7/1985 | Cothrell | 51/262 A |
| 4,793,895 | 12/1988 | Kaanta et al. | 156/627 |
| 4,959,928 | 10/1990 | Hartwig, Sr. | 51/262 A |

*Primary Examiner*—Roscoe V. Parker

*Attorney, Agent, or Firm*—Galfee, Halter & Griswold

[57] ABSTRACT

An air jet assembly supported over a polishing pad provides for raising flattened fibers pressed down by the polishing of semiconductor wafers and for blowing spent polishing materials and by-products off the pad. The polishing pad is supported on a rotatable platen and includes fibers which normally extend substantially perpendicular to an upper surface of the polishing pad. The fibers are coated with chemicals for polishing the surface of semiconductor wafers during the chip fabrication process. The fibers of the polishing pad tend to flatten down against the platen during the polishing process and spent polishing materials and by-products become embedded in the fibers of the pad. The air jet assembly is supported over the pad and includes an elongated pipe having an inlet port and a plurality of output ports. The inlet port is coupled to an air supply which forces air into the pipe and out through the outlet ports. The outlet ports direct the air at an angle against the rotating pad to raise the flattened fibers to their proper orientation and to blow away the spent polishing materials and by- products from the pad produced during the polishing process.

34 Claims, 1 Drawing Sheet

PNEUMATIC PAD CONDITIONER

This is a continuation of copending application Ser. No. 07,721,733, filed on June 26, 1991, and now abandoned.

FIELD OF THE INVENTION

The present invention relates to a process and apparatus for raising flattened fibers on a pad designed for polishing semiconductor wafers and also for removing polishing by-products and spent polishing material from the surface of the pad.

BACKGROUND OF THE INVENTION

During the fabrication process of certain semiconductor wafers, it is necessary to polish the wafer to selectively remove excess material, e.g., oxides, polysilicon, and aluminum, from a surface of the wafer. Such polishing is frequently referred to as "planarization", wherein an appropriate chemical is applied to the wafer to selectively remove an outer layer of material from the surface, while leaving embedded material to provide appropriate patterning for the wafer.

To polish the wafer, the wafer is supported on a carrier and is in contact with a generally circular polishing pad. The polishing pad has an outer surface of polyethylene terephthalate (i.e., MYLAR), and elongated fibers extending upwardly from the surface. The elongated fibers are coated with the appropriate chemical and brought into contact with a surface of the semiconductor wafer. As the pad is rotated and the fibers move across the surface of the wafer, the unwanted material is removed from the wafer.

During the polishing process, spent polishing materials and by-products become imbedded in the fibers of the polishing pad. Moreover, the fibers tend to become flattened against the polishing pad which results in a "glazed" effect on the surface of the pad. The flattened fibers and imbedded spent polishing materials and by-products reduce the efficiency of the polishing process by extending the time required to polish the wafer. In fact the pads finally became so filled with by-products or become so glazed no further polishing action will occur.

It is known that processes have been developed for reconditioning polishing pads. For example, direct pad contacting means such as nylon brushes, sandpaper, or diamond-coated blades are used. However, these processes generally require interruption of the wafer polishing process and in certain instances require removal of the polishing pad from the polishing assembly. Moreover, since these processes abrade the surface of the pads, the polishing pads must still be replaced frequently, and in some cases after only a few (e.g., ten) semiconductor wafers have been polished.

One technique which has been developed for removing particles from a planar surface is described in U.S. Pat. No. 3,031,195, to Lunsford. This patent shows an apparatus for removing particles from the surface of a phonograph record wherein air is directed downwardly through a tone arm against the surface of the record to remove the particles.

Other techniques have been developed for removing residue on polishing pads. Some of these techniques are shown in Drzewiecki, U.S. Pat. No. 3,907,257; and Scandaletos, U.S. Pat. No. 3,754,359. The Drzewiecki patent shows a tubular housing designed to have a polishing pad wrapped around the circumference of the housing. A plurality of openings are formed in the housing which allow air to pass through the pad and remove residue. Similarly, the Scandaletos patent shows a perforated, flexible disc designed to provide an airflow through the perforations when the disc is rotated. The airflow removes residue on the surface of the disc.

The foregoing references that disclose techniques for removing residue or particles from a polishing pad generally require the fluid to pass through the pad and none were capable of working with pads having imperious backing and were not designed to: 1) raise flattened fibers of a polishing pad, and 2) to simultaneously remove by-products and spent polishing materials from the surface of the pad during the polishing process and 3) to do so without interruption of the polishing process. The present invention accomplishes all this while allowing not only proper polishing of each semiconductor wafer, in the same amount of time but does so without frequent replacement of the polishing pads and without interruption of the polishing process.

SUMMARY OF THE INVENTION

The present invention provides a process and apparatus for raising flattened fibers of a polishing pad and additionally relates to removing polishing by-products and spent polishing material from the polishing pad for proper polishing of semiconductor wafers. The apparatus comprises a jet assembly having an elongated pipe supported over the polishing pad. The jet assembly provides a downwardly-directed stream of a fluid such as air against the polishing pad. The stream of air raises the flattened fibers on the pad and removes the polishing by-product and spent polishing material during the polishing process.

The polishing pad is supported on a rotatable platen and is comprised of a plurality of fibers normally extending substantially perpendicular to an upper surface of the polishing pad. The fibers are designed to be coated with appropriate chemicals and brought into contact with a surface of the semiconductor wafer to thereby chemically- mechanically (Chem-Mech) polish the wafer as the platen is rotated.

The elongated pipe of the air jet assembly is supported over the polishing pad and extends radially inwardly toward the rotational axis of the polishing pad. One end of the pipe includes an inlet port coupled to an air supply. A series of outlet ports are formed along the length of the pipe and are directed downwardly at an angle against the surface of the polishing pad. When the air supply is operating, air is forced through the outlet ports and directed against the surface of the rotating polishing pad. The stream of air raises the flattened pad fibers to their normal orientation, and simultaneously removes the spent polishing material and by-products from the pad.

One feature of the present invention is to provide an apparatus for raising flattened fibers on a pad designed to polish semiconductor wafers, and for removing polishing by-products and spent polishing material from the pad, while not interrupting the wafer polishing process.

Another feature of the present invention is to provide a multi-purpose apparatus which removes polishing by-products and spent polishing materials from a polishing pad and which raises flattened fibers on the pad without contacting the pad.

Still another feature of the present invention is to provide an efficient apparatus for removing polishing by-products and spent polishing material from a polishing pad and for raising flattened polishing pad fibers on the pad. The apparatus is simple and convenient to operate, and increases the number of semiconductor wafers which can be polished before replacement of the polishing pad is necessary.

Further features and advantages of the present invention will become apparent from the following detailed description and the accompanying drawings.

DETAILED DESCRIPTION OF THE PREFERRED EMBODIMENT

Figure 1:
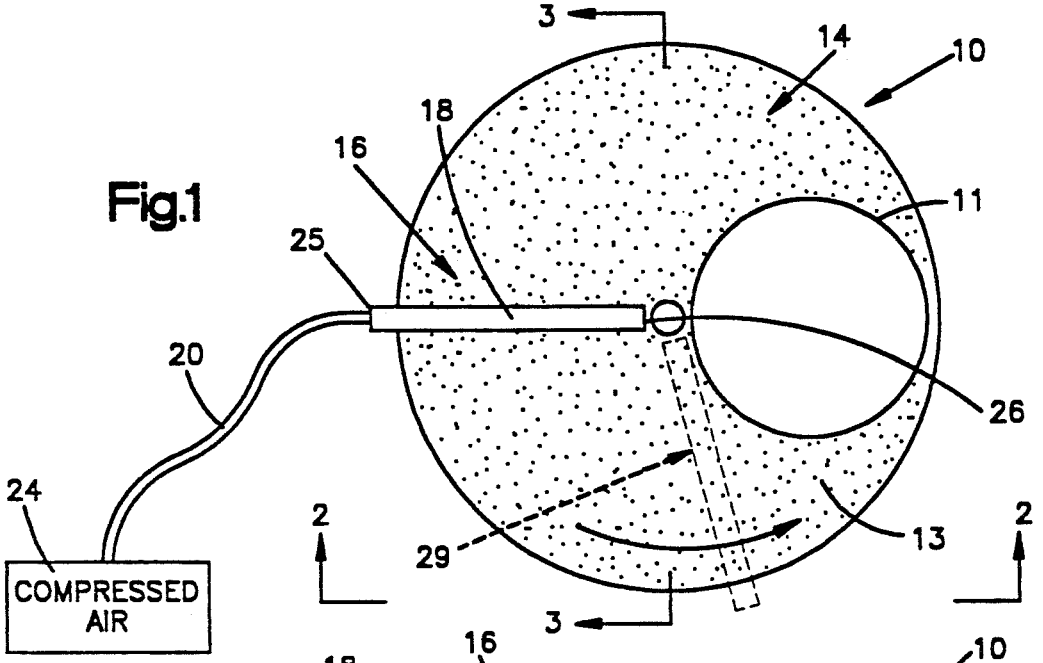
FIG. 1 is a top plan view of an air jet apparatus constructed according to the present invention located over a polishing pad.
Figure 2:
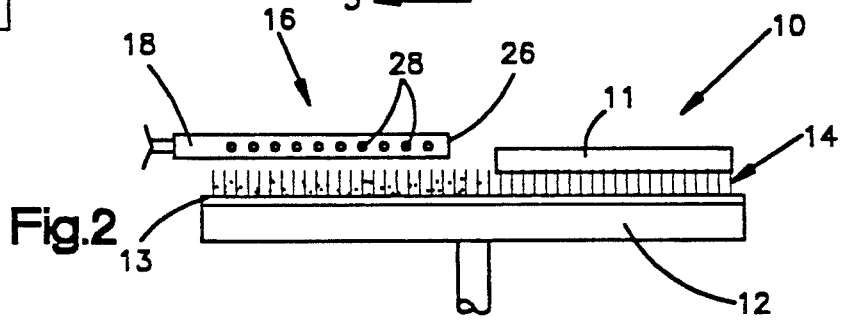
FIG. 2 is a longitudinal sectional view of the air jet apparatus and polishing pad taken substantially along the plane described by the lines 2—2 of FIG. 1.
Figure 3:
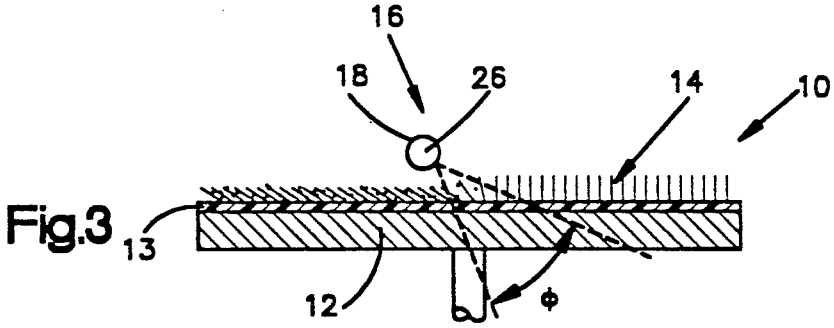
FIG. 3 is a transverse sectional view of the air jet apparatus and polishing pad taken substantially along the plane described by the line 3—3 of FIG. 1.

Referring to the drawings, and initially to FIGS. 1-3, a polishing pad, indicated generally at 10, is designed to polish a surface of a semiconductor wafer (indicated at 11) during the wafer fabrication process. The polishing process and the operation of the device of this invention will be described as they relate to the Chemical Mechanical Planarization (CMP) process, as described in U.S. Pat. No. 4,793,895 which is assigned to the assignee of the present invention. It will be understood, however, that the apparatus and process with this invention can be used with other processes which remove different materials e.g., oxides, polysilicon and aluminum, from the surface of the semiconductor wafer.

The pad 10 is substantially circular in top plan view and is supported on a rotatable platen 12. The pad 10 is generally composed of number of elongated fibers 14, normally extending substantially perpendicular to the upper surface of the pad for contacting and polishing the surface of the semiconductor wafer. The pad 10 is backed with an impervious surface 13 such as polyethylene terephthalate (i.e., MYLAR). A chemical, appropriate to the material being polished plus a suitable abrasive, is continuously applied, in the form of a slurry, to the pad to remove the unwanted material from the wafer during the polishing process.

During the semiconductor wafer fabrication process, the fibers 14 tend to become flattened during the polishing process (see e.g., FIG. 3). Moreover, polishing by-products and spent polishing material tend to become imbedded in the fibers of the pad. Additionally, a "glazed" effect becomes apparent on the surface of the polishing pad. The flattened fibers and the imbedded polishing by-products and spent polishing material degrades the polishing efficiency of the pad.

According to the present invention, an air jet assembly, indicated generally at 16, is supported in spaced relationship to the surface of the polishing pad. The air jet assembly 16 includes an elongated pipe 18 coupled by a flexible tube 20 to an air supply 24.

The elongated pipe 18 is formed from rigid plastic or other appropriate material and preferably extends radially inward toward the rotational axis of the polishing pad. One end of the pipe 18 includes an inlet port 25 connected to the flexible tube 20, while the other end is closed by an end cap 26. The pipe 18 of the air jet assembly can be pivotally connected on a swivel block (not shown) to the support structure of the platen. Accordingly, the pipe 18 can be moved away from the platen during replacement of the polishing pad.

Figure 4:
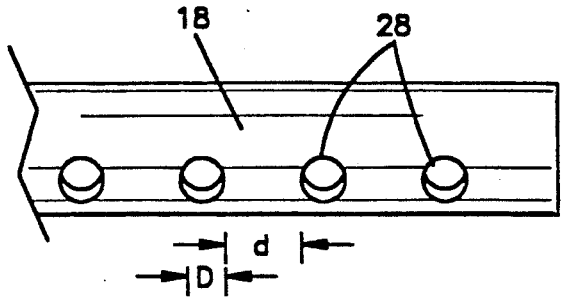
FIG. 4 is a view of a portion of the air jet apparatus as shown in FIG. 2 on an enlarged scale.

As illustrated in FIGS. 2 and 4, a plurality of perforations, as indicated at 28, are formed in the wall of the pipe 18. Each of the perforations 28 has a diameter D. The perforations are preferably equally spaced at d intervals along the length of the pipe 18. The distance d between the edges of the perforations and the diameter of the perforations is preferably equal. It has been determined that for the above-described process the diameter D and distance d should be approximately ⅛". Alternatively, it is also within the scope of the invention to provide a thin slot extending along the length of the pipe in lieu of the perforations.

The air supply 24 is conventional in design and provides compressed air (or other appropriate gas or liquid) through the flexible tube 20 to the inlet port 25 of the pipe 18. The air fills the pipe and is forced through the perforations 28 in a substantially uniform stream. The perforations 28 direct the air downwardly against the fibers on the polishing pad at an angle $\phi$ (FIG. 3), which angle is approximately 45° in the direction of rotation of the platen.

As illustrated most clearly in FIG. 3, as the platen 12 is rotated, the chemical is applied through an applicator, as indicated generally in phantom at 29, to the fibers of the polishing pad. The fibers move across the surface of the wafer as the polishing pad rotates. The chemical on the fibers removes the polishing material being polished, which along with the polishing by-products, becomes imbedded in the fibers of the pad. Additionally, the fibers on the pad become flattened during contact with the wafer surface. The downwardly directed stream of air is applied at an angle $\phi$ against the flattened fibers on the polishing pad 10. The air tends to blow away the polishing by-products and spent polishing material from the pad and raise the flattened fibers to their normal orientation substantially perpendicular to the surface of the polishing pad. Moreover, the "glazing" of the fibers during polishing is prevented by this blowing away of the material and the polishing by-products. As the platen continues to rotate, the raised fibers are again coated with the chemical and contact and polish the surface of the semiconductor wafer.

Tests have been conducted using the air jet assembly supported over a polishing pad where 8" semiconductor wafers were being polished. The pad was rotated on the platen at a rate of 35 rpm. The perforations in the pipe provided air at 65 PSIG at a 45° angle against the flattened fibers on the polishing pad in the direction of rotation. It has been determined that the air jet assembly removes the spent polishing materials and by-products from the pad and raises the flattened pad fibers. It has further been determined that the air jet assembly increases the useable life of the polishing pads during the wafer polishing process. In particular, it was determined that a single polishing pad could to polish up to 500 semiconductor wafers before replacement when the air jet assembly was operating. In contrast, it was found that polishing pads had to be replaced after only 40 wafers were polished when the air jet assembly was not operating. The increase in useable pad lifetime was therefore 1250%.

Accordingly, the present invention provides a air jet apparatus which is simple and convenient to use and which efficiently removes spent polishing materials and by- products from the surface of a polishing pad. Moreover, the apparatus provides for raising the flattened fibers of the polishing pad to their normal orientation for proper polishing of semiconductor wafers during the wafer fabrication process.

Although the invention has been shown and described with respect to a certain preferred embodiment, it is obvious that equivalent alterations and modifications will occur to others skilled in the art upon their reading and understanding of the specification. For example, fluids such as water, solvents, the polishing fluid or the like can be substituted for the air discussed above. The present invention includes all such equivalent alterations and modifications, and is limited only by the scope of the following claims.

What is claimed is:

1. An apparatus for polishing a semiconductor wafer, comprising:

a rotatable platen, a polishing pad supported on said platen, said polishing pad having fibers normally extending substantially perpendicular to a surface of said polishing pad and tending to flatten against the surface during polishing of the semiconductor wafer, and an elongated conduit supported in spaced relation to said polishing pad, said conduit having an inlet and an outlet, said inlet being coupled to gas supply, and said outlet being directed toward the surface of said fiber polishing pad, said gas supply adapted to provide gas through said outlet to raise the flattened fibers substantially perpendicular to the surface of said polishing pad.

2. An apparatus as in claim 1, wherein spent polishing material and by-products tend to become imbedded in said polishing pad during polishing of the semiconductor wafer, and said outlet of said elongated conduit is adapted to provide gas to blow away said spent polishing material and by-products from the surface of said polishing pad.

3. An apparatus as in claim 2, wherein said polishing pad is substantially circular in top plan view and said elongated conduit extends substantially across the radius of said polishing pad.

4. An apparatus as in claim 3, wherein said outlet of said conduit comprises plural openings equally spaced across said elongated conduit.

5. An apparatus as in claim 4, wherein said plural openings extend across the radius of said polishing pad.

6. An apparatus as in claim 5, wherein said conduit is formed from plastic.

7. An apparatus as in claim 1, wherein said outlet of said conduit is directed at an angle with respect to the surface of said polishing pad, said angle being approximately 45° in the direction of rotation of said platen.

8. An apparatus as in claim 1, wherein said conduit is pivotally supported over said polishing pad.

9. An apparatus as in claim 1, wherein said gas supply provides air through said conduit at approximately 65 PSIG.

10. A method for reconditioning a polishing pad having flattened fibers for polishing a semiconductor wafer, comprising the steps of:

rotating the polishing pad, supporting an elongated conduit in spaced relation to a surface of said polishing pad, said conduit having an inlet and an outlet, forcing gas through said inlet into said conduit and out through said outlet, said outlet directing the gas against the polishing pad to raise the flattened fibers substantially perpendicular to the surface of said polishing pad.

11. A method for reconditioning a polishing pad as in claim 10, wherein the gas is forced through plural openings in said outlet of said conduit at an angle of approximately 45° in the direction of rotation of said polishing pad.

12. An apparatus for polishing a semiconductor wafer having a layer of material applied to a surface, comprising:

a rotatable platen, a polishing pad supported on said platen, said polishing pad having fibers normally extending substantially perpendicular to a surface of said polishing pad and adapted to be coated with a material removing solution, said coated fibers of said polishing pad adapted to be brought into contact with the surface of the semiconductor wafer to selectively remove the material during the polishing of the semiconductor wafer, said polishing pad tending to have spent polishing material and by-products imbedded in said pad and said fibers tending to flatten against the surface of said polishing pad during contact with the surface of the semiconductor wafer, and an elongated conduit supported in spaced relation to said polishing pad, said conduit having an inlet port and a plurality of outlet ports, said inlet port being coupled to a gas supply, and said outlet ports being directed toward the upper surface of said fiber polishing pad, said gas supply adapted to provide gas through said outlet ports to raise the flattened fibers substantially perpendicular to said polishing pad and to blow away the spent polishing material and by-products from the polishing pad.

13. An apparatus as in claim 12, wherein said polishing pad is substantially circular in top plan view and said elongated conduit extends substantially across the radius of said polishing pad.

14. An apparatus as in claim 13, wherein said outlet ports are equally spaced across said elongated conduit.

15. An apparatus as in claim 14, wherein said outlet ports extend across the radius of said polishing pad.

16. An apparatus as in claim 15, wherein said conduit is formed from plastic.

17. An apparatus as in claim 12, wherein said outlet ports are directed at an angle with respect to the surface of said polishing pad, said angle being approximately 45° in the direction of rotation of said platen.

18. An apparatus as in claim 12, wherein said conduit is pivotally supported over said polishing pad.

19. An apparatus as in claim 12, wherein said gas supply provides air through said conduit at approximately 65 PSIG.

20. An apparatus for polishing a semiconductor wafer, comprising:

a rotatable polishing pad having fibers on an upper surface normally extending substantially perpendicular to the surface of said polishing pad and tending to flatten against the surface during polishing of the semiconductor wafer, and a gas dispensing device supported in spaced relation to the surface of said polishing pad, said gas dispensing device having an inlet and an outlet, said inlet being coupled to an gas-generating means, and said outlet being directed toward the surface of said fiber polishing pad, said gas-generating means adapted to provide air through said outlet to raise the flattened fibers on said polishing pad substantially perpendicular to the surface of said pad.

21. An apparatus as in claim 20, wherein spent polishing material and by-products tend to become imbedded in said polishing pad during polishing of the semiconductor wafer, and said outlet of said elongated conduit is adapted to provide gas to blow away said spent polishing material and by-products from the surface of said polishing pad.

22. An apparatus as in claim 21, wherein said polishing pad is substantially circular in top plan view and said elongated conduit extends substantially across the radius of said polishing pad.

23. An apparatus as in claim 22, wherein said outlet of said conduit comprises plural openings equally spaced across said elongated conduit.

24. An apparatus as in claim 23 wherein said plural openings extend across the radius of said polishing pad.

25. An apparatus as in claim 24, wherein said conduit is formed from plastic.

26. An apparatus as in claim 20, wherein said outlet of said conduit is directed at an angle with respect to the surface of said polishing pad, said angle being approximately 45° in the direction of rotation of said platen.

27. An apparatus as in claim 20, wherein said conduit is pivotally supported over said polishing pad.

28. An apparatus as in claim 20, wherein said gas supply provides air through said conduit at approximately 65 PSIG.

29. A method for reconditioning a polishing pad having flattened fibers for polishing a semiconductor wafer, comprising the steps of:

rotating the polishing pad, supporting an elongated conduit in spaced relation to a surface of said polishing pad, said conduit having an inlet and an outlet, forcing a fluid through said inlet into said conduit and out through said outlet, said outlet directing the fluid against the polishing pad to raise the flattened fibers substantially perpendicular to the surface of said polishing pad.

30. An apparatus for polishing a semiconductor wafer, comprising:

a rotatable platen, a polishing pad supported on said platen, said polishing pad having fibers normally extending away from a surface of said polishing pad and which tend to flatten against the surface during polishing of the semiconductor wafer, and an elongated conduit supported in spaced relation to said polishing pad, said conduit having an inlet and an outlet, said inlet being coupled to gas supply, and said outlet being directed toward the surface of said fiber polishing pad, said gas supply adapted to provide gas through said outlet to raise the flattened fibers way from the surface of said polishing pad.

31. A method for reconditioning a polishing pad having flattened fibers for polishing a semiconductor wafer, comprising the steps of:

rotating the polishing pad, supporting an elongated conduit in spaced relation to a surface of said polishing pad, said conduit having an inlet and an outlet, forcing gas through said inlet into said conduit and out through said outlet, said outlet directing the gas against the polishing pad to raise the flattened fibers away from the surface of said polishing pad.

32. An apparatus for polishing a semiconductor wafer having a layer of material applied to a surface, comprising:

a rotatable platen, a polishing pad supported on said platen, said polishing pad having fibers normally extending away from a surface of said polishing pad and adapted to be coated with a material removing solution, said coated fibers of said polishing pad adapted to be brought into contact with the surface of the semiconductor wafer to selectively remove the material during the polishing of the semiconductor wafer, said polishing pad tending to have spent polishing material and by-products imbedded in said pad and said fibers tending to flatten against the surface of said polishing pad during contact with the surface of the semiconductor wafer, and an elongated conduit supported in spaced relation to said polishing pad, said conduit having an inlet port and a plurality of outlet ports, said inlet port being coupled to a gas supply, and said outlet ports being directed toward the upper surface of said fiber polishing pad, said gas supply adapted to provide gas through said outlet ports to raise the flattened fibers away from the surface of the polishing pad and to blow away the spent polishing material and by-products from the polishing pad.

33. An apparatus for polishing a semiconductor wafer, comprising:

a rotatable polishing pad having fibers on an upper surface normally extending away from the surface of said polishing pad and tending to flaten against the surface during polishing of the semiconductor wafer, and a gas dispensing device supported in spaced relation to the surface of said polishing pad, said gas dispensing device having an inlet and an outlet, said inlet being coupled to an gas-generating means, and said outlet being directed toward the surface of said fiber polishing pad, said gas-generating means adapted to provide air through said outlet to raise the flattened fibers on said polishing pad away from the surface of said pad.

34. An apparatus for polishing a semiconductor wafer, comprising:

a rotatable platen, a polishing pad supported on said platen, said polishing pad having fibers which normally extend away from a surface of said polishing pad, said polishing pad having spent polishing material and by-products imbedded in said polishing pad and the fibers flattened against the surface of said polishing pad during the polishing of the semiconductor wafer, and an elongated conduit supported in spaced relation to said polishing pad, said conduit having an inlet and an outlet, said inlet being coupled to gas supply and said outlet being directed toward the surface of said fiber polishing pad, said gas supply adapted to provide gas through said outlet to blow away said spent polishing material and by-products from the surface of said polishing pad.

* * * * *